US007552558B1

(12) United States Patent
Ballard

(10) Patent No.: US 7,552,558 B1
(45) **Date of Patent: *Jun. 30, 2009**

(54) MIRROR SIGHT APPARATUS WITH INTEGRAL REAR SIGHT

(76) Inventor: Marlin Daniel Ballard, 4900 W. William Cannon Dr., Austin, TX (US) 78749

( * ) Notice: Subject to any disclaimer, the term of this patent is extended or adjusted under 35 U.S.C. 154(b) by 194 days.

This patent is subject to a terminal disclaimer.

(21) Appl. No.: 11/521,915

(22) Filed: Sep. 15, 2006

Related U.S. Application Data

(63) Continuation-in-part of application No. 10/954,776, filed on Sep. 30, 2004, now Pat. No. 7,225,576, which is a continuation-in-part of application No. 10/877,013, filed on Jun. 26, 2004, now Pat. No. 7,140,142.

(51) Int. Cl.
*F41G 1/00* (2006.01)

(52) U.S. Cl. ..... 42/111; 42/118; 42/90; 42/148; 356/255

(58) Field of Classification Search ..... 356/255; 42/118, 90, 111, 148
See application file for complete search history.

(56) References Cited

U.S. PATENT DOCUMENTS

| | | | | | |
|---|---|---|---|---|---|
| 40,256 | A | * | 10/1863 | Garretson | 42/111 |
| 694,904 | A | * | 3/1902 | Youlten | 42/118 |
| 708,720 | A | * | 9/1902 | Konig | 359/402 |
| 813,932 | A | | 2/1906 | Youlten | |
| 880,378 | A | * | 2/1908 | Geis | 356/254 |
| 1,176,893 | A | * | 3/1916 | Hartney | 356/254 |
| 1,227,544 | A | | 5/1917 | Lobdell | |
| 1,260,285 | A | | 3/1918 | Cordell | |
| 1,264,133 | A | | 4/1918 | Morris | |
| 2,412,298 | A | * | 12/1946 | Siazik | 356/254 |
| 3,262,440 | A | | 7/1966 | Kuhn | |
| 3,749,494 | A | * | 7/1973 | Hodges | 356/16 |
| 3,817,148 | A | * | 6/1974 | Schirneker | 89/155 |
| 3,863,354 | A | * | 2/1975 | Karppinen | 42/118 |
| 4,878,305 | A | | 11/1989 | Gabrielidis | |
| 5,653,034 | A | * | 8/1997 | Bindon | 42/131 |
| 5,933,972 | A | * | 8/1999 | Springer, Jr. | 42/133 |
| 6,311,424 | B1 | * | 11/2001 | Burke | 42/118 |
| 6,643,969 | B1 | | 11/2003 | Avizonis | |
| 6,715,227 | B2 | | 4/2004 | Swain | |
| 6,901,691 | B1 | * | 6/2005 | Little | 42/118 |
| 6,931,778 | B1 | * | 8/2005 | Nelson et al. | 42/120 |
| 7,257,920 | B1 | * | 8/2007 | Shaffer et al. | 42/118 |
| 7,356,962 | B2 | * | 4/2008 | Swan | 42/147 |
| 2001/0022044 | A1 | * | 9/2001 | Spinner | 42/124 |
| 2005/0241210 | A1 | * | 11/2005 | Karcher et al. | 42/119 |

* cited by examiner

*Primary Examiner*—Michelle Clement
(74) *Attorney, Agent, or Firm*—David O. Simmons

(57) ABSTRACT

A targeting apparatus for a gun comprises a mirror assembly, a mounting base and a sighting device. The mirror assembly includes a single utilized mirror having a target imaging surface. The mounting base has the mirror assembly moveably attached thereto. The single utilized mirror is movable between a sighting device use position thereof with respect to the mounting base and a mirror use position thereof with respect to the mounting base. The sighting device is attached to the mirror assembly. The sighting device includes a sighting member configured for being aligned with a mating alignment member of a companion sighting device when the single utilized mirror is in the sighting device used position thereby enabling precision aiming through combined use of said sighting devices. The sighting member is independently adjustable for windage and for elevation.

20 Claims, 7 Drawing Sheets

MIRROR SIGHT APPARATUS WITH INTEGRAL REAR SIGHT

RELATED APPLICATIONS

This application is a continuation-in-part of application Ser. No. 10/954,776 (filed on Sep. 30, 2004 now U.S. Pat. No. 7,225,576, entitled "Mirror Sight Apparatus For Guns" and having a common applicant herewith), which is a continuation-in-part application Ser. No. 10/877,013 (filed on Jun. 26, 2004 now U.S. Pat. No. 7,140,142, entitled "Mirror Sight Apparatus For Guns" and having a common applicant herewith).

FIELD OF THE DISCLOSURE

The inventive disclosures made herein relate generally to sighting apparatuses and systems for guns and, more particularly, to apparatuses and systems configured for enabling a gun to be fired from cover positions in an aimed manner.

BACKGROUND

Apparatuses that are configured for use on a gun (e.g. a rifle, a handgun, paintball gun, etc.) for permitting a shooter of the gun to fire it from a cover position in an aimed manner are known (i.e., conventional cover-position sighting apparatuses). Examples of such apparatuses are disclosed in U.S. Pat. Nos. 6,643,969; 6,311,424; 3,863,354; 3,262,440; 1,264,133; 1,260,285; 1,227,544; 880,378; 813,932; 694,904 and 187,432. In permitting a shooter of the gun to fire it from a cover position in an aimed manner, the shooter of the gun is able to remain substantially out of a line of enemy fire while being able to fire at hostile targets in an aimed manner. Firing in this manner in a hostile or potentially hostile engagement saves lives and saves ammunition, both of which are important endeavours in a hostile or potentially hostile engagement.

Such conventional cover-position sighting apparatuses are known to have limitations that adversely affect their effectiveness, desirability and/or practicality. One limitation of certain conventional cover-position sighting apparatuses is that they are inefficient in enabling a desired target to be accurately and timely acquired, even with excessive training. This is unacceptable as it puts shooters at risk and such training can often be in conflict with preferred engagement tactics. Some of such conventional apparatuses have the limitation of making a gun cumbersome due to being non-stowable, being non-removable, being difficult to remove and/or their physical size. This adversely impacts their mobility and convenience, makes them susceptible to damage and/or puts them in the way of other components of the gun. Another limitation of some conventional apparatuses is that they generate images that are distorted and/or disorienting, making it difficult to aim in an accurate and/or repeatable manner. Still another limitation of some conventional apparatuses is that they include multiple mirrors that require an undesirably high degree of alignment for enabling effective aiming. Some conventional apparatuses require a shooter to have close facial proximity to the gun in order to acquire a desired target, which is often a limitation in that this can adversely affect safety of the shooter. Yet another limitation of some conventional apparatuses is that they are overly expensive to implement, maintain and/or replace.

Therefore, apparatuses and systems configured for enabling a gun to be fired from cover positions in an aimed manner and that they at least partially overcome limitations associated with such conventional approaches for enabling firing from cover positions would be useful and novel.

SUMMARY OF THE DISCLOSURE

In one embodiment, a targeting apparatus for a gun comprises a mirror assembly, a mounting base and a sighting device. The mirror assembly includes a single utilized mirror having a target imaging surface. The mounting base has the mirror assembly moveably attached thereto. The single utilized mirror is movable between a sighting device use position thereof with respect to the mounting base and a mirror use position thereof with respect to the mounting base. The sighting device is attached to the mirror assembly. The sighting device includes a sighting member configured for being aligned with a mating alignment member of a companion sighting device when the single utilized mirror is in the sighting device used position thereby enabling precision aiming through combined use of the sighting devices. The sighting member is independently adjustable for windage and for elevation.

In another embodiment, a targeting system for a gun comprises a target acquisition apparatus, a single-mirror target viewing apparatus and a sighting device. The target acquisition apparatus includes a mounting structure mountable on a mounting rail of a gun for enabling the target acquisition apparatus to be secured to the mounting rail and includes a means for visually indicating when the gun is aimed at a desired target. The single-mirror target viewing apparatus includes a mounting base and a mirror assembly movably attached to the mounting base. The mounting base includes a mounting structure mountable on the mounting rail for enabling the single-mirror target viewing target apparatus to be secured to the mounting rail. The mirror assembly includes a single utilized mirror providing a target imaging surface. The single-mirror target viewing apparatus enables a shooter to view on the target imaging surface both the desired target and the means for visually indicating when the gun is aimed at a desired target while the target acquisition apparatus and the single-mirror target viewing apparatus are both secured to the mounting rail with the single utilized mirror in the mirror use position. The sighting device is attached to the mirror assembly of the single-mirror target viewing apparatus. A sighting member of the sighting device is alignable with a mating alignment member of a companion sighting device when the single utilized mirror is in the sighting device use position thereby enabling precision aiming through combined use of the sighting devices. The sighting member is independently adjustable for windage and for elevation.

In another embodiment, a targeting apparatus for a gun comprises a mounting rail, a single-mirror target viewing apparatus, a sighting device, a plurality of positive positioning structures and a locking structure. The single-mirror target viewing apparatus includes a mounting base and a mirror assembly movably attached to the mounting base. The mounting base is attached to the mounting rail. The mirror assembly includes a single utilized mirror providing a target imaging surface. The single-mirror target viewing apparatus enables a shooter to view on the target imaging surface both the desired target and the means for visually indicating when the gun is aimed at a desired target while the target acquisition apparatus and the single-mirror target viewing apparatus are both secured to the mounting rail with the single utilized mirror in the mirror use position. The sighting device is attached to the mirror assembly. The sighting device includes a sighting member configured for being aligned with a mating alignment member of a companion sighting device when the single utilized mirror is in the sighting device used position thereby enabling precision aiming through combined use of the sighting devices. The sighting member is independently adjustable for windage and for elevation. A first positive positioning structure is provided between the mirror assembly and the mounting base. A second positive positioning structure is provided between the single utilized mirror and a base attachment portion of the mirror assembly. The position structures jointly enable the single utilized mirror to be positively positioned in a plurality of predefined positions through action of the first positive positioning structure providing for positive positioning of the mirror assembly relative to the mounting base and the second positive positioning structure providing for positive positioning of the single utilized mirror relative to the base attachment portion of the mirror assembly.

Accordingly, it is a principal object of the present invention to provide apparatuses and systems configured for enabling a gun to be fired from cover positions in an aimed manner and that at least partially overcomes limitations associated with conventional approaches for enabling firing from cover positions. Specifically, apparatuses and systems in accordance with embodiments of the disclosures made herein are simple and timely in their ability to accurately acquire a desired target, without requiring excessive training to become proficient in their use and/or training that is in conflict with preferred engagement tactics. Such apparatuses and systems are relatively small and non-obtrusive, which enhances their mobility, durability and convenience, particularly when configured for being stowable. They provide clear and intuitive imaging of targets and means for visually indicating when the gun is aimed at a desired target. They are mountable in a manner that is simple and that readily permit their removal. Their single utilized mirror configuration does not require precision alignment as is required by multiple mirror apparatuses. Their single utilized mirror can be made large enough to eliminate the need for close facial proximity to the weapon while still achieving accurate aiming and providing safety for the shooter. Finally, they are relatively inexpensive to implement, maintain and/or replace.

These and other objects, embodiments, advantages and/or distinctions of the present invention will become readily apparent upon further review of the following specification, associated drawings and appended claims.

DETAILED DESCRIPTION OF THE DRAWINGS

Figure 1:
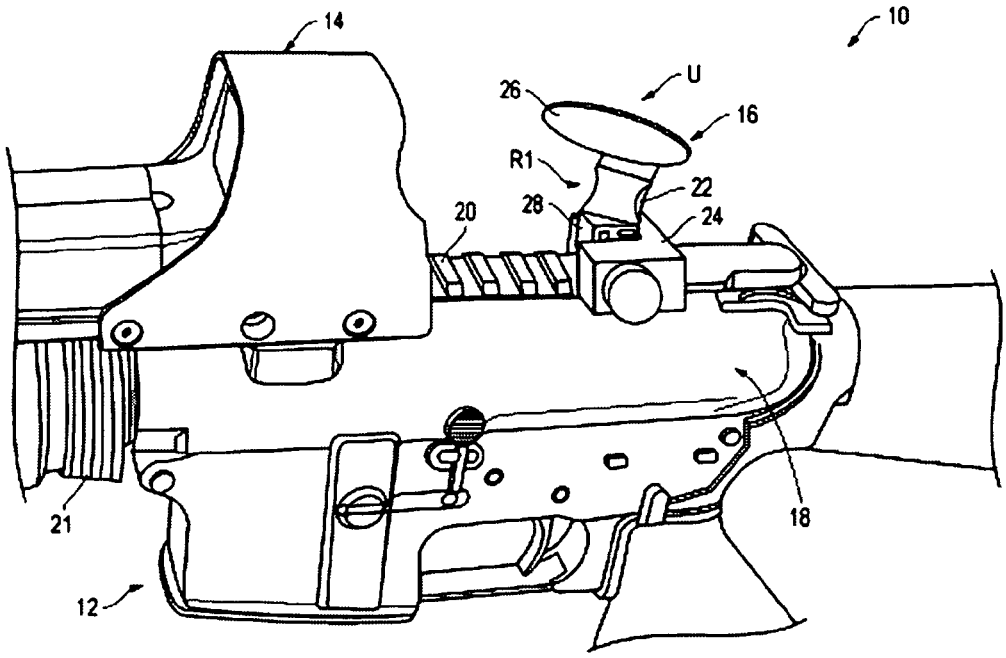
FIG. 1 is a partial perspective view showing an embodiment of a gun having a single-mirror target viewing apparatus in accordance with the present invention mounted thereon, wherein a single utilized mirror of the single-mirror target viewing apparatus of the gun is in a use position.
Figure 2:
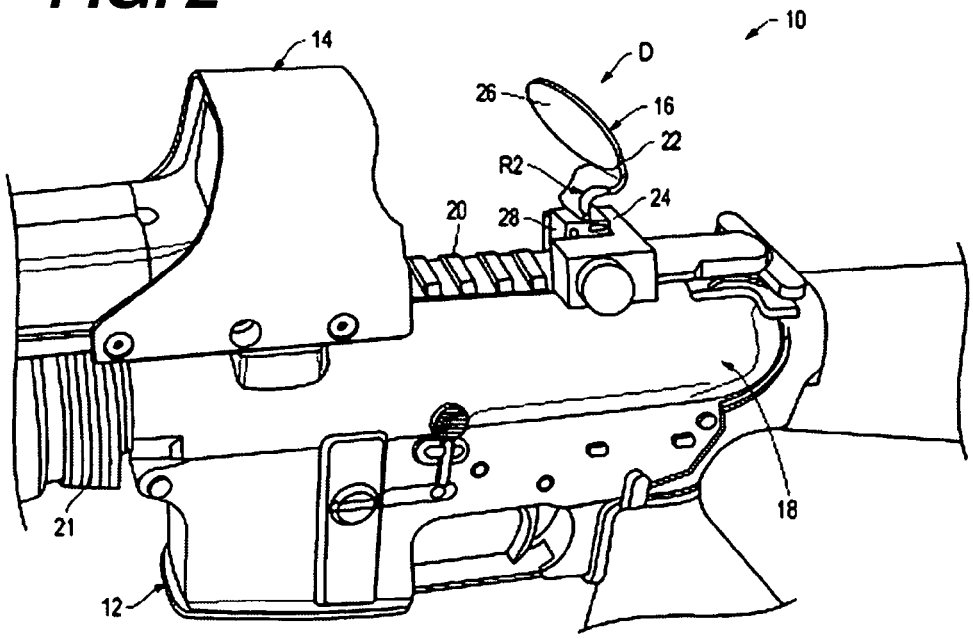
FIG. 2 is a partial perspective view of the single-mirror target viewing apparatus shown in FIG. 1, wherein the single utilized mirror is in a deployed position.
Figure 3:
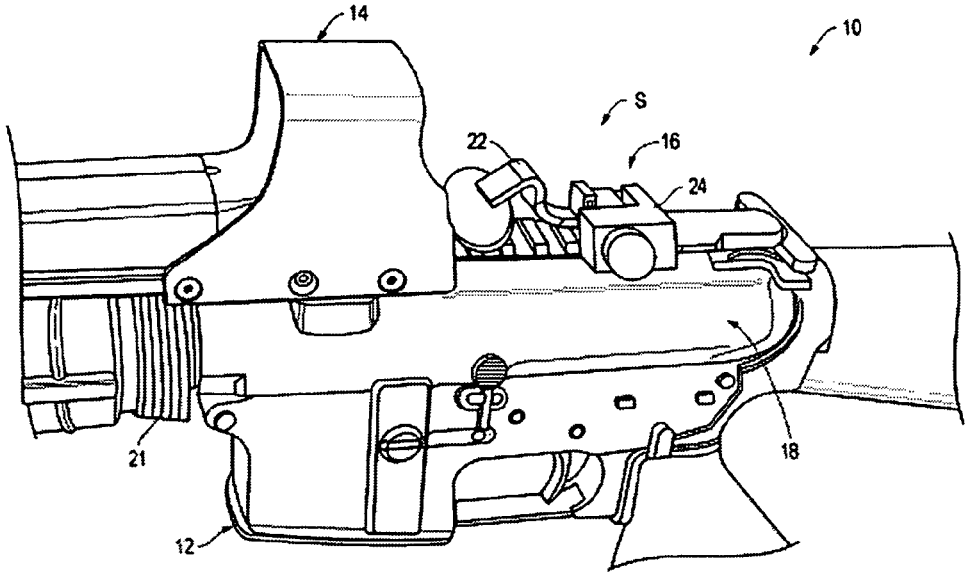
FIG. 3 is a partial perspective view of the single-mirror target viewing apparatus shown in FIG. 1, wherein the single utilized mirror is in a stowed position.

FIGS. 1-3 depict a first embodiment of a gun 10 adapted for enabling the gun 10 to be fired at a desired target from a cover position (e.g., around a corner of a wall, from over the top of an embankment, etc) in an aimed manner. The gun 10 includes a gun body 12, a target acquisition apparatus 14 and a single-mirror target viewing apparatus 16. The gun body 12 includes a receiver 18 and a mounting rail 20 (e.g., weaver rail or picatinny rail) attached the receiver 18. The single-mirror target viewing apparatus 16 depicted in FIGS. 1-3 is an embodiment of a single-mirror target viewing apparatus in accordance with an embodiment of the inventive disclosures made herein. The target acquisition apparatus 14 and a single-mirror target viewing apparatus 16 depicted in FIGS. 1-3 jointly represent a gun sight system in accordance with an embodiment of the inventive disclosures made herein.

The target acquisition apparatus 14 and the single-mirror target viewing apparatus 16 are attached to the mounting rail 20 of the gun body 12. As depicted, the target acquisition apparatus 14 and the single-mirror target viewing apparatus 16 are discrete apparatuses mounted directly on, the mounting rail 20 of the gun body 12. It is contemplated herein that, in other embodiments, (not shown), the target acquisition apparatus 14 and the single-mirror target viewing apparatus 16 may be discrete apparatuses indirectly attached to the mounting rail 20 through a separate mounting device (e.g., precision-formed interposer rail) or may be an adjoined assembly (e.g., mounted on a common support structure) that is attached directly or indirectly to the mounting rail 20.

Alternately, the target acquisition apparatus 14 and/or the single-mirror target viewing apparatus 16 may be mounted on or integrated with components of the gun body 12 other than the mounting rail 20. For example, the single mirror target viewing apparatus 16 may be an integral component of the rear iron sights on a long-barrel gun (e.g., rifle or shot gun) or may be mounted on a carry handle of a long-barrel gun (e.g., a carrying handle of a M-16 style rifle).

As depicted in FIGS. 1-3, the target acquisition apparatus 14 and the single-mirror target viewing apparatus 16 are mounted above a barrel portion 21 of the gun 10. It is contemplated herein that the target acquisition apparatus 14 and the single-mirror target viewing apparatus 16 may be mounted below the barrel portion 21 of the gun 10 or to a side of the barrel portion 21 of the gun 10. The specific mounted location will depend on factors such as shooter preference, intended application, gun configuration (e.g., hand gun, rifle, shotgun, etc) and gun design (e.g., integral mounting devices).

The target acquisition apparatus 14 includes means for visually indicating when the gun 10 is aimed at a desired target. Examples of the target acquisition apparatus 14 include optical sight apparatuses, opto-electical sight apparatuses, and conventional mechanical sight apparatuses. An optical scope is an example of an optical sight apparatus. Trijicon brand, Docter Optic brand and EOTech brand target acquisition apparatuses are examples of opto-electical sight apparatuses that utilize laser, holographic, LED reflection and/or optical technologies. Examples of conventional mechanical sights include mechanical sights provided on the gun 10 by its original equipment manufacturer and accessory mechanical sights configured for being attached to the gun 10 after its manufacture. Accordingly, a person of ordinary skill will understand that examples of such means for visually indicating when the gun 10 is aimed at a desired target include well-known elements of optical sight apparatuses opto-electical sight apparatuses, and conventional mechanical sight apparatuses that are configured for visually indicating when a gun is aimed at a desired target. More specifically, embodiments of such means for visually indicating when a gun is aimed at a desired target include alignment marks on an optic lens of an optical sight apparatus, an illumination mark on a display screen of an opto-electical sight apparatus, and a mechanical structure (e.g., a bead, an upstanding post, an upstanding bridge or the like) of a conventional mechanical sight apparatuses. On a long-barrel gun (e.g., a rifle or shotgun), if an accessory front sight is required, attaching such accessory front sight on one side or both of a front tower sight construction (e.g., on an M-16 style rifle) is one preferred position. Alternatively, such an accessory front sight could be affixed to the barrel, to a barrel-insulating device or to an accessory rail that is attached to the barrel portion 21 or the receiver 18.

The single-mirror target viewing apparatus 16 includes a mirror assembly 22 and a mounting base 24. The mirror assembly 22 is movably attached to the mounting base 24. The mirror assembly 22 includes a single utilized mirror 26 (i.e., one or more redundant mirrors are contemplated) that defines a target imaging surface (e.g., reflective surface of the single utilized mirror). Preferably, the single utilized mirror 26 is essentially flat. The mounting base 24 is attached to the mounting rail 18 of the gun body 12.

The mirror assembly 22 is moveably attached to the mounting base 24 in a manner enabling the mirror assembly 22 to be pivoted and rotated with respect to the mounting base 24. In this manner, the single utilized mirror 26 is movable between a stowed position S (FIG. 3) and a deployed position D (FIG. 2) and is movable between a plurality of rotational positions. For example, the single utilized mirror 26 is movable to a first rotated position R1 (FIG. 1) for achieving a use position U and to a second rotate position R2 (FIG. 2) for enabling the mirror assembly 22 to be positioned in the stowed position S. Preferably, an axis of rotation of the mirror assembly 22 and/or the single utilized mirror 26 with respect to the mounting base 24 extends through a central region of the single utilized mirror 26. As disclosed above, the single utilized mirror 26 defines a target imaging surface, which as shown in FIGS. 1 and 2 is within the central region of the single utilized mirror 26. Thus, in at least one embodiment of the present invention, the axis of rotation of the single utilized mirror 26 extends through the target imaging surface of the single utilized mirror 26 when the single utilized mirror 26 is in a use position U. In this manner, the target imaging surface of the single utilized mirror 26 is skewed with respect to the axis of rotation of the single utilized mirror 26 when the single utilized mirror 26 is in the use position U such that the axis of rotation of the single utilized mirror 26 extends through the target imaging surface of the single utilized mirror 26 at a single point when the single utilized mirror 26 is in the use position U. Preferably, but not necessarily, the target imaging surface of the single utilized mirror 26 is skewed with respect to the axis of rotation of the single utilized mirror 26 throughout an entire range of rotation of the single utilized mirror 26 when the single utilized mirror 26 is in the deployed position D. It should be understood that the first rotated position R1 depicted in FIG. 1 is one example of a rotated position corresponding to a use position of the mirror assembly 22.

It is contemplated herein that, in an alternate embodiment (not shown) the mirror assembly 22 is positioned adjacent to one of the sides of the gun body 12 when in the stowed position S. Preferably, when in such a stowed position S, the single utilized mirror 26 faces the gun body 12 so as to protect the single utilized mirror 26 from damage. Optionally, a protective stowage enclosure (not shown) may be provided in which the single mirror is positioned when in the stowed position S.

Preferably, the mirror assembly 22 is selectively securable in the stowed position S and the deployed position D. In one embodiment, the mirror assembly 22 and the mounting base 24 are jointly configured for selectively securing the mirror assembly 22 in the stowed position S and the deployed position D. The mirror assembly 22 and the mounting base 24 including mating features (e.g., a biased positioning means and a detent) is one example of the mirror assembly 22 and the mounting base 24 being jointly configured for selectively securing the mirror assembly 22 in the stowed position S and the deployed position D.

Preferably, the mirror assembly 22 is selectively securable in one or more rotational positions (e.g., R1, R2, etc). To this end, the mirror assembly 22 includes a base attachment portion 28 to which the single utilized mirror 26 is rotatably attached and to which the mounting base 24 is pivotally attached. In such embodiment, the base attachment portion 28 and the single utilized mirror 26 are jointly configured for selectively securing the single utilized mirror 26 in one or more rotational positions with respect to the mounting base 24. The single utilized mirror 26 and the base attachment portion 28 including mating features (e.g., a biased positioning means and a detent) is one example of the mirror assembly 22 being configured for enabling the single utilized mirror 26 to be selectively secured in one or more rotational positions.

When in the use position U, the target imaging surface of the single utilized mirror 26 is in a skewed orientation with respect to a longitudinal axis of the barrel portion 21 of the gun 10. In this orientation, a desired target and means for visually indicating when the target is acquired in an aimed manner may be viewed on the target imaging surface with the gun held in a partially rotated position (i.e., rotated along its longitudinal axis to a position between about the 12 o'clock position and about the 3 o'clock or 9 o'clock positions). Accordingly, the single-mirror target viewing apparatus 16 enables a shooter to view on the target imaging surface both the desired target and the means for visually indicating when the gun is aimed at a desired target, thereby enabling the gun to be to accurately fired from a cover position in an aimed manner.

Figure 4:
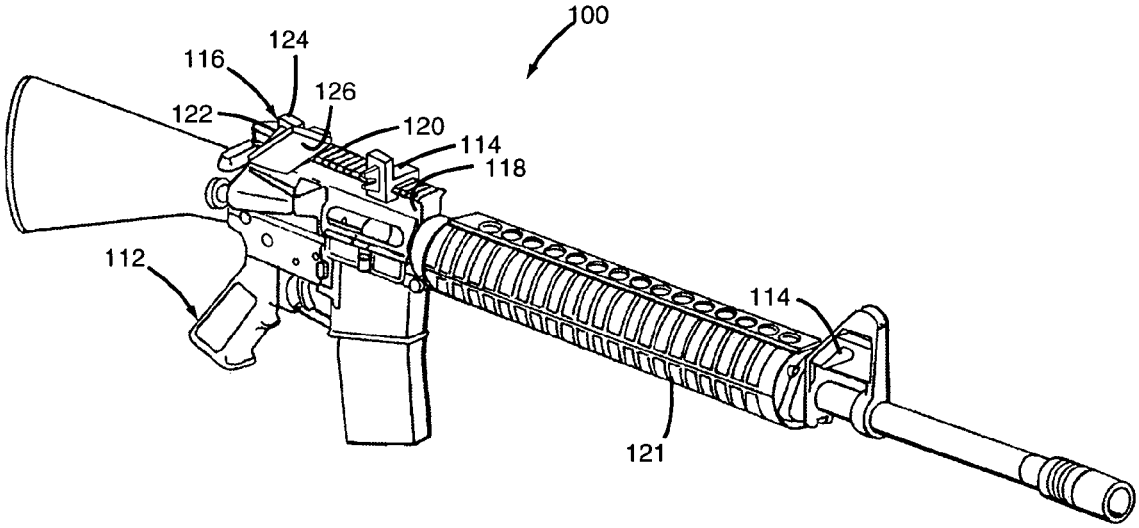
FIG. 4 is a perspective view showing a gun having a single utilized mirror in accordance with the present invention mounted thereon in a fixed orientation.

FIG. 4 depicts a second embodiment of a gun 100 adapted for enabling the gun 100 to be fired at a desired target from a cover position (e.g., around a corner of a wall, from over the top of an embankment, etc) in an aimed manner. The gun 100 includes a gun body 112, a target acquisition apparatus 114 (i.e., front and rear physical sights) and a single-mirror target viewing apparatus 116 that is fixedly attached (i.e., non-rotating and non-pivoting) to the gun body 112. The gun body 112 includes a receiver 118 and a mounting rail 120 attached the receiver 118. The single-mirror target viewing apparatus 116 depicted in FIG. 4 is an embodiment of a single-mirror target viewing apparatus in accordance with an embodiment of the inventive disclosures made herein. The target acquisition apparatus 114 and a single-mirror target viewing apparatus 116 depicted n FIG. 4 jointly represent a gun sight system in accordance with an embodiment of the inventive disclosures made herein.

The target acquisition apparatus 114 and the single-mirror target viewing apparatus 116 are attached to the mounting rail 120 of the gun body 1112. As depicted, the target acquisition apparatus 114 and the single-mirror target viewing apparatus 116 are discrete apparatuses mounted directly on the mounting rail 120 of the gun body 112. It is contemplated herein that, in other embodiments, (not shown), the target acquisition apparatus 114 and the single-mirror target viewing apparatus 116 may be discrete apparatuses indirectly attached to the mounting rail 120 through a separate mounting device (e.g., precision-formed interposer rail) or may be an adjoined assembly (e.g., mounted on a common support structure) that is attached directly or indirectly to the mounting rail 120.

As depicted in FIG. 4, the target acquisition apparatus 114 and the single-mirror target viewing apparatus 116 are position to a right side of the gun body 112. It is contemplated herein that, in other embodiments (not shown), the target acquisition apparatus 114 and the single-mirror target viewing apparatus 116 may be positioned to a left side of the gun body 112 or a second single-mirror target viewing apparatus 116 may be mounted opposite the first single-mirror target viewing apparatus 16 (i.e., opposite the single-mirror target viewing apparatus 116 depicted in FIG. 4). The specific mounted location and number of target viewing apparatuses will depend on factors such as shooter preference, intended application, gun configuration (e.g., hand gun, rifle, etc) and gun design (e.g., integral mounting devices).

The target acquisition apparatus 114 includes means for visually indicating when the gun 100 is aimed at a desired target. Examples of the target acquisition apparatus 114 include optical sight apparatuses, opto-electical sight apparatuses, and conventional mechanical sight apparatuses. An optical scope is an example of an optical sight apparatus. Trijicon brand, Docter Optic brand and EOTech brand target acquisition apparatuses are examples of opto-electical sight apparatuses that utilize laser, holographic, LED reflection and/or optical technologies. Examples of conventional mechanical sights include mechanical sights provided on the gun 100 by its original equipment manufacturer and accessory mechanical sights configured for being attached to the gun 10 after its manufacture. On a long-barrel gun (e.g., a rifle or shotgun), if an accessory front sight is required, attaching such accessory front sight on one side or both of a front tower sight construction (e.g., on an M-16 style rifle) is one preferred position. Alternatively, such an accessory front sight could be affixed to the barrel, to a barrel-insulating device or to an accessory rail that is attached to the barrel portion 121 or the receiver 118.

The single-mirror target viewing apparatus 116 includes a mirror assembly 122 and a mounting base 124. The mirror assembly 122 is fixedly (i.e., non-rotating and non-pivoting) to the mounting base 124 and includes a single utilized mirror 126 that define a target imaging surface (e.g., reflective surface of the single utilized mirror). Preferably, the single utilized mirror 126 is essentially flat. The mounting base 124 is attached to the mounting rail 120 of the gun body 112.

When in the use position U, the target imaging surface of the single utilized mirror 126 is in a skewed orientation with respect to a longitudinal axis of the barrel portion 121 of the gun 100. In this orientation, a desired target and means for indicating when the target is acquired in an aimed manner may be viewed on the target imaging surface with the gun held in a partially rotated position (i.e., rotated along its longitudinal axis to a position between about the 12 o'clock position and about the 3 o'clock or 9 o'clock positions). Accordingly, single-mirror target viewing apparatus 116 enables a shooter to view on the target imaging surface both the desired target and the means for visually indicating when the gun is aimed at a desired target, thereby enabling the gun to be to accurately fired from a cover position in an aimed manner.

Guns configured with target viewing apparatuses in accordance with the inventive disclosures made herein are used in conjunction with a target acquisition apparatus to facilitate accurately shooting from a cover position (e.g., around a corner) with minimal or no exposure of the shooter's body. Such target viewing apparatuses are positioned generally in line with and behind an associated target acquisition apparatus. Such target viewing apparatuses include a single utilized mirror that may be adjustable to allow for tilting the gun at different horizontal angles (i.e. laid over on its side relative to the shooter). It is preferable for the mirror to be positioned so as to require the shooter to lay the gun at a minimum of approximately 45 degrees from vertical in order to use a wall or other obstacle to protect as much of the shooter's hand as possible. For left-handed shooting (i.e., the right side of the gun exposed to the shooter) on guns with a right side ejection port, it is preferred that the mirror be positioned so as to require that the gun be laid over to a degree where cartridges will not be ejected into the shooter's face.

Use of target viewing apparatuses in accordance with the inventive disclosures made herein in conjunction with handguns to facilitate accurately shooting from a cover position is contemplated. Generally, the underlying configuration discussed above in reference to long barrel guns also applies to handguns. In one embodiment specific to handguns, the target viewing apparatus and an opto-electrical target acquisition apparatus are mounted beneath the barrel of the handgun. Accordingly, the shooter can accurately aim and shoot around a corner by utilizing the mirror to acquire the target and to aim. Preferably, adjustability of the mirror is restricted so as to require the shooter to orient the gun in a non-vertical orientation. The non-vertical position serves the purpose of helping to protect the shooter's hand behind cover and also protect the shooter's face from shells that are being ejected out of the gun.

Figure 5:
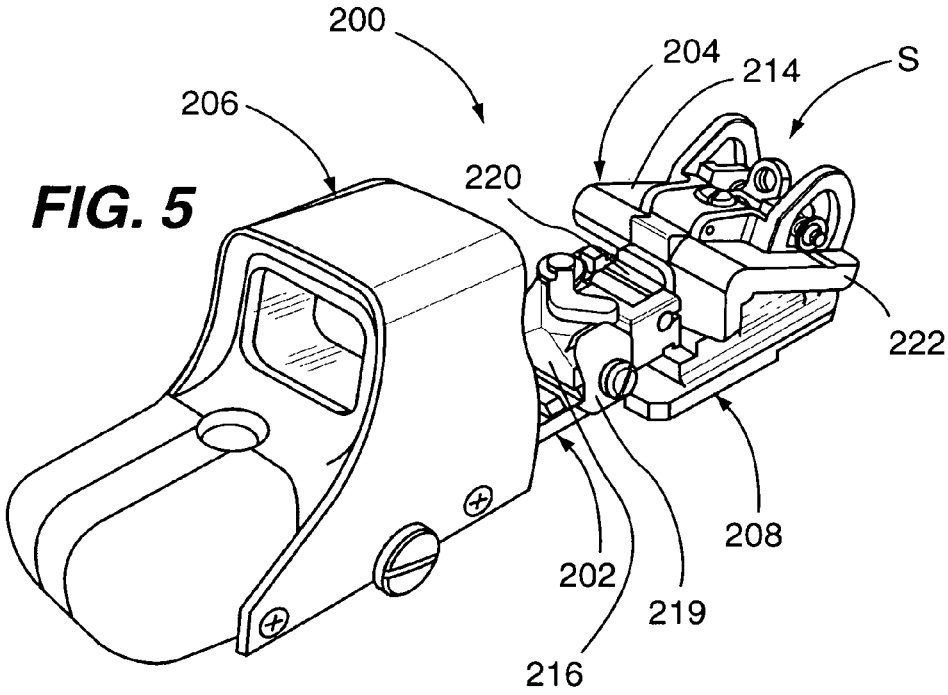
FIG. 5 is a perspective view showing a targeting system in accordance with the present invention, wherein a single utilized mirror of the targeting system is in a stowed position.
Figure 6:
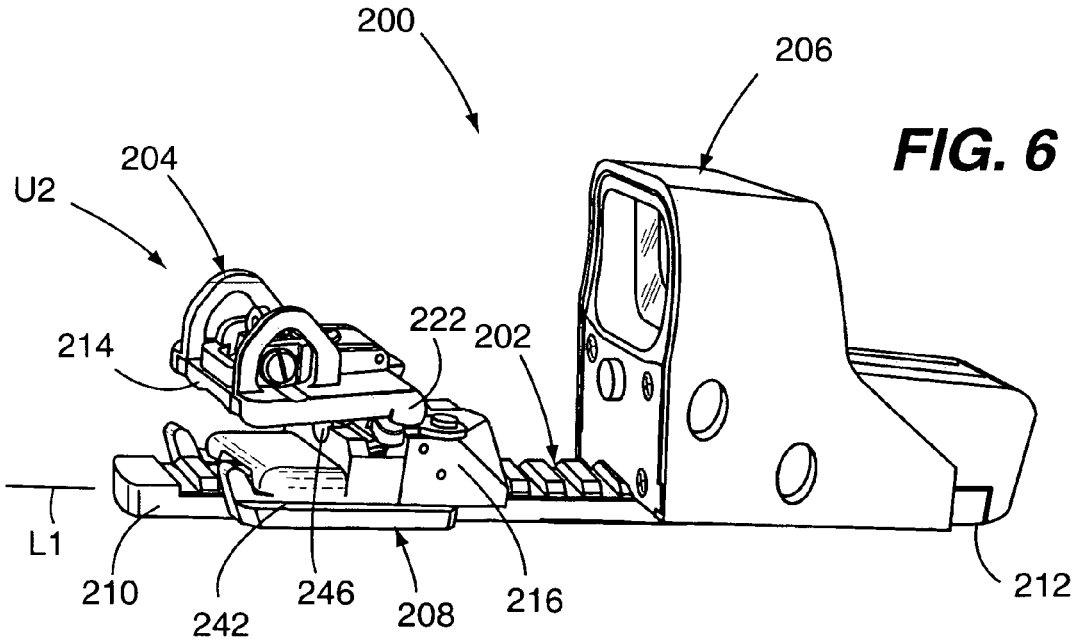
FIG. 6 is a perspective view of the targeting system of FIG. 5 showing the single utilized mirror in a sighting device use position.
Figure 7:
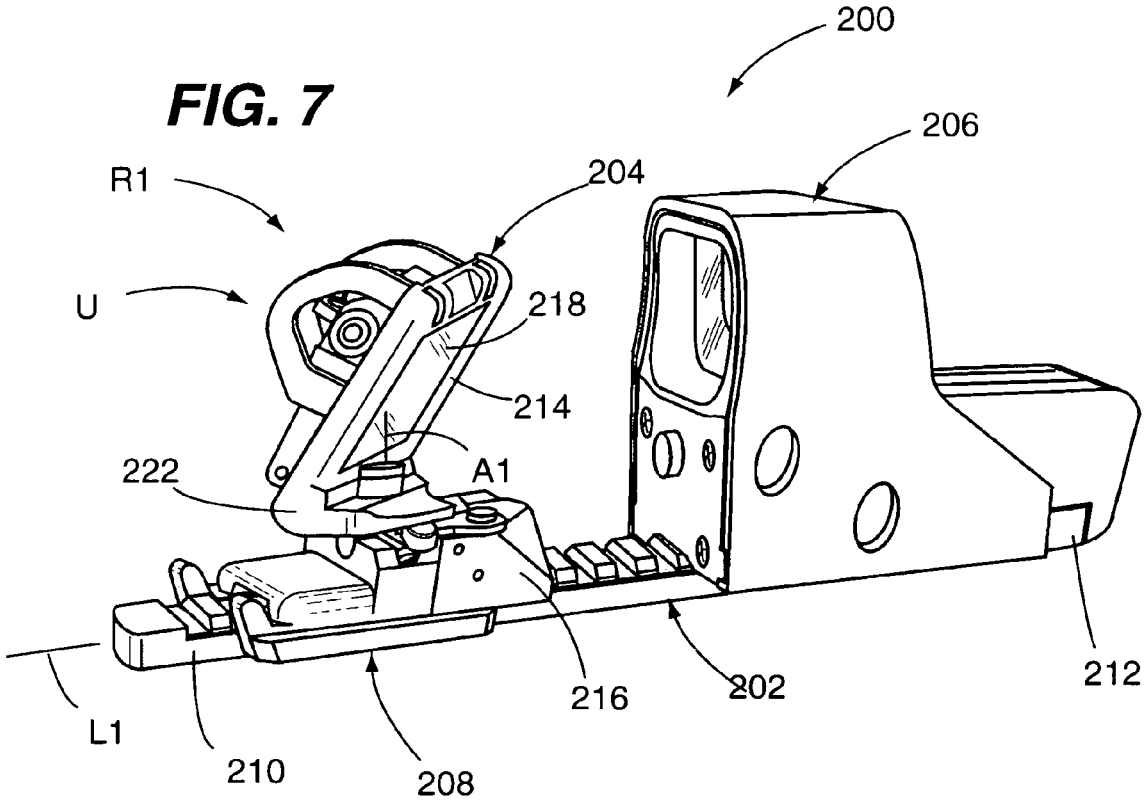
FIG. 7 is a perspective view of the targeting system of FIG. 5 showing the single utilized mirror in a mirror use position.

FIGS. 5-7 show a targeting system in accordance with the present invention, which is referred to herein as the targeting system 200. The targeting system 200 includes a mounting rail 202, a single-mirror target viewing apparatus 204, a target acquisition apparatus 206 and a mirror shrouding apparatus 208. The single-mirror target viewing apparatus 204, the target acquisition apparatus 206 and the mirror shrouding apparatus 208 are fixedly mounted on the mounting rail 202. The mounting rail 202 is of a standard configuration (e.g., industry standardized) for being attached to a receiver or other portion of a gun and for having accessory items mounted thereon. Alternatively, the mounting rail 202 may be integrally formed with the receiver or other portion of a gun.

The single-mirror target viewing apparatus 204 is mounted adjacent a first end portion 210 of the mounting rail 202 and the target acquisition apparatus 206 is mounted adjacent a second end portion 212 of the mounting rail 202. In this mounted configuration, the single-mirror target viewing apparatus 204 is in spaced-apart relationship with the target acquisition apparatus 206 with respect to a longitudinal axis L1 of the mounting rail 202. The mirror shrouding apparatus 208 extends from adjacent the single-mirror target viewing apparatus 204 toward the first end portion of the mounting rail 202.

The target acquisition apparatus 206 includes means for visually indicating when a gun on which the targeting system 200 is mounted is aimed at a desired target. Examples of the target acquisition apparatus 206 include optical sight apparatuses, opto-electrical sight apparatuses, and conventional mechanical sight apparatuses. An optical scope is an example of an optical sight apparatus. Trijicon brand, Docter Optic brand and EOTech brand target acquisition apparatuses are examples of opto-electical sight apparatuses that utilize laser, holographic, LED reflection and/or optical technologies. Examples of conventional mechanical sights include mechanical sights provided on a gun by its original equipment manufacturer and accessory mechanical sights configured for being attached to the gun after its manufacture. On a long-barrel gun (e.g., a rifle or shotgun), if an accessory front sight is required, attaching such accessory front sight on one side or both of a front tower sight construction (e.g., on an M-16 style rifle) is one preferred position. Alternatively, such an accessory front sight could be affixed to the barrel, to a barrel-insulating device or to an accessory rail that is attached to a barrel portion or a receiver potion of the gun.

The single-mirror target viewing apparatus 204 includes a mirror assembly 214 and a mounting base 216. The mirror assembly 214 is movably attached to the mounting base 216. The mirror assembly 214 includes a single utilized mirror 218 (FIG. 7) that defines a target imaging surface (e.g., exposed reflective surface of the single utilized mirror 218). Preferably, but not necessarily, the single utilized mirror 218 is essentially flat. The mounting base 216 is attached to the mounting rail 202 by a clamping structure 219 (FIG. 5).

The mirror assembly 214 is moveably attached to the mounting base 216 in a manner enabling the mirror assembly 214 to be pivoted between a plurality of positions with respect to the mounting base 216 and to be rotated between a plurality of rotational positions with respect to the mounting base 216. In this manner, the single utilized mirror 218 (i.e., in combination with the mirror assembly 214) is movable between a stowed position S (FIG. 5), a mirror use position U (FIG. 7) and a sighting device use position U2 (FIG. 6). The stowed position S and the a sighting device use position U2 are both examples of mirror non-use positions in accordance with the present invention.

As discussed below in greater detail, when the single utilized mirror 218 is in the mirror use position U, the single-mirror target viewing apparatus 204 enables a shooter to view on the target imaging surface of the single utilized mirror 218 both a desired target and the means for visually indicating that the gun is aimed at a desired target. As is discussed below in greater detail, when the single utilized mirror 218 is in the sighting device use position U2, a sighting device attached to the mirror assembly 214 is in a respective use position.

Preferably, an axis of rotation of the mirror assembly 214 and/or the single utilized mirror 218 with respect to the mounting base 216 extends through a central region of the single utilized mirror 218. As disclosed above, the single utilized mirror 218 defines a target imaging surface, which as shown in FIG. 7 is within the central region of the single utilized mirror 218. Thus, in at least one embodiment of the present invention, the axis of rotation A1 (FIG. 7) of the single utilized mirror 218 extends through the target imaging surface of the single utilized mirror 218 when the single utilized mirror 218 in the mirror use position U. In this manner, the target imaging surface of the single utilized mirror 218 is skewed with respect to the axis of rotation A1 of the single utilized mirror 218 when the single utilized mirror 218 is in the mirror use position U. Accordingly, the axis of rotation A1 of the single utilized mirror 218 extends through the target imaging surface of the single utilized mirror 218 at a single point when the single utilized mirror 218 is in the mirror use position U and is skewed with respect to the longitudinal axis L1 of the mounting rail 202. Preferably, but not necessarily, the target imaging surface of the single utilized mirror 218 is skewed with respect to the axis of rotation A1 of the single utilized mirror 218 throughout an entire range of rotation of the single utilized mirror 218. It should be understood that the mirror use position U depicted in FIG. 7 is one example of a rotated position, which so happens to corresponding to a particular mirror use position of the mirror assembly 214. Preferably, but not necessarily, the mirror assembly 214 is rotatable a fully 360 degrees or, at least a substantial portion thereof.

Preferably, the mirror assembly 214 is positively positioned (i.e., selectively securable) in the stowed position S, the sighting device use position U2 and the mirror use position U. To this end, a first positive positioning structure is provided between the mirror assembly 214 and the mounting base 216 and a second positive positioning structure is provided between the single utilized mirror 218 and a base attachment portion 220 (FIG. 5) of the mirror assembly 214. The positive position structures jointly enable the single utilized mirror 218 to be positively positioned in a plurality of predefined positions. The mirror use position U, the sighing device use position U2 and the stowed position S are examples of such predefined positions.

In one embodiment, the positive positioning structures each include a locating member than engages a mating feature for facilitating such positive positioning. With respect to the first positive positioning structure, an example of such a structure includes a spring loaded element of the mounting base 216 that selectively engages each one of a plurality of mating feature of the base attachment portion 220 for providing positive positioning of the mirror assembly 214 with respect to the mounting base 216. The plurality of mating features (e.g., detent features) are provided in spaced apart relationship with respect to each other for enabling positive positioning of the base attachment portion 220 at positions corresponding to the mirror use position U, the sighting device use position U2 and the stowed position S. It is disclosed herein that the relative association of the locating member and a mating feature with the mounting base 216 and the base attachment portion 220 may be reversed while still providing positive positioning functionality. With respect to the second positive positioning structure, an example of such a structure includes a spring loaded element of the base attachment portion 220 that selectively engages each one of a plurality of mating feature of a mirror casing 222 of the single utilized mirror 218 for providing positive positioning of the single utilized mirror 218 with respect to the base attachment portion 220. The plurality of mating features (e.g., detent features) are provided in spaced apart relationship with respect to each other for enabling positive positioning of the mirror assembly 214 at positions corresponding to the mirror use position U, the sighting device use position U2 and the stowed position S. It is disclosed herein that the relative association of the locating member and a mating feature with the base attachment portion 220 and the mirror assembly 218 may be reversed while still providing positive positioning functionality.

Figure 8:
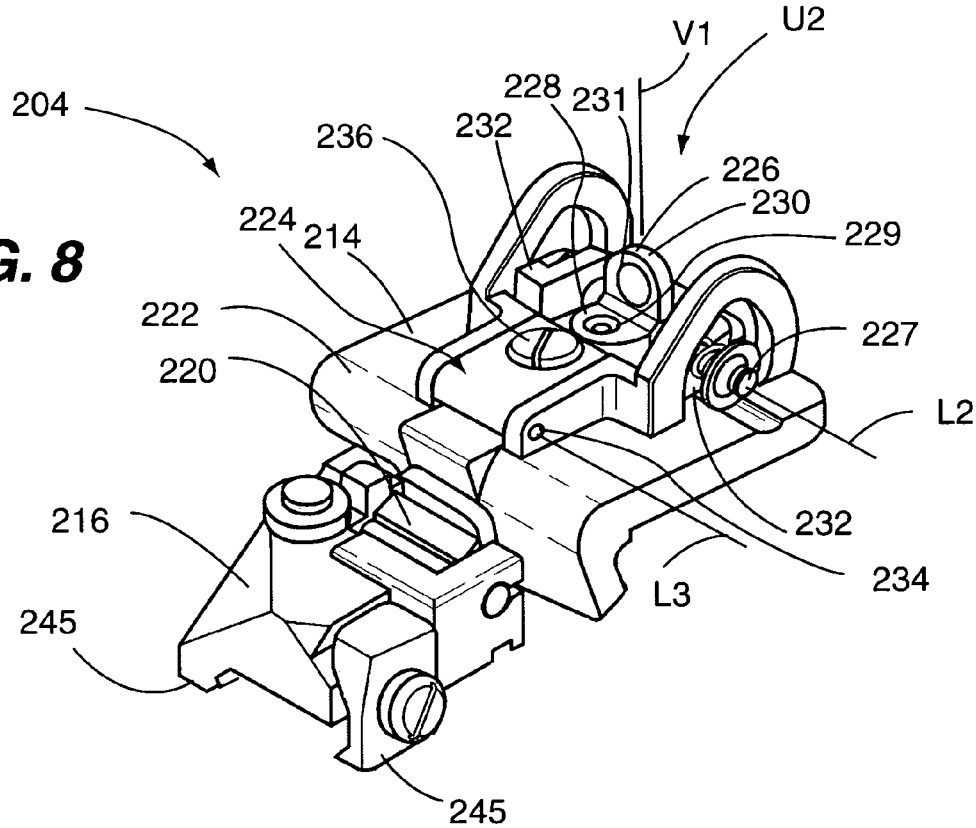
FIG. 8 is a perspective view of the single-mirror target viewing apparatus of FIG. 1 showing a sighting member of a sighting device thereof in a first use orientation.
Figure 9:
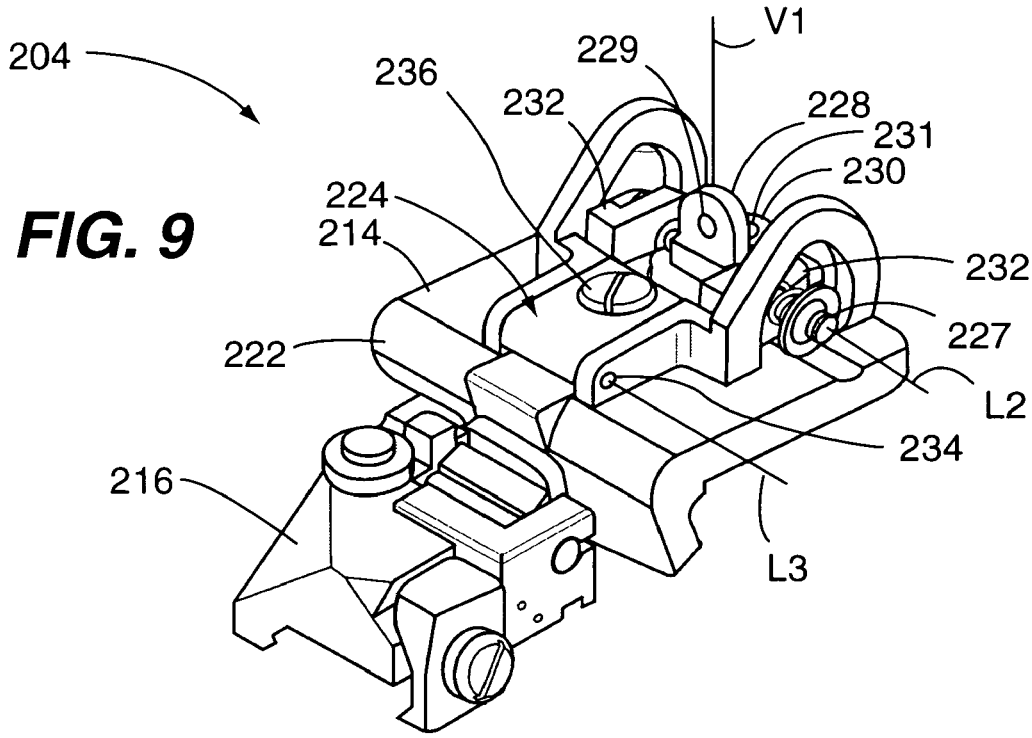
FIG. 9 is a perspective view of the single-mirror target viewing apparatus of FIG. 1 showing a sighting member of a sighting device thereof in a second use orientation.
Figure 10:
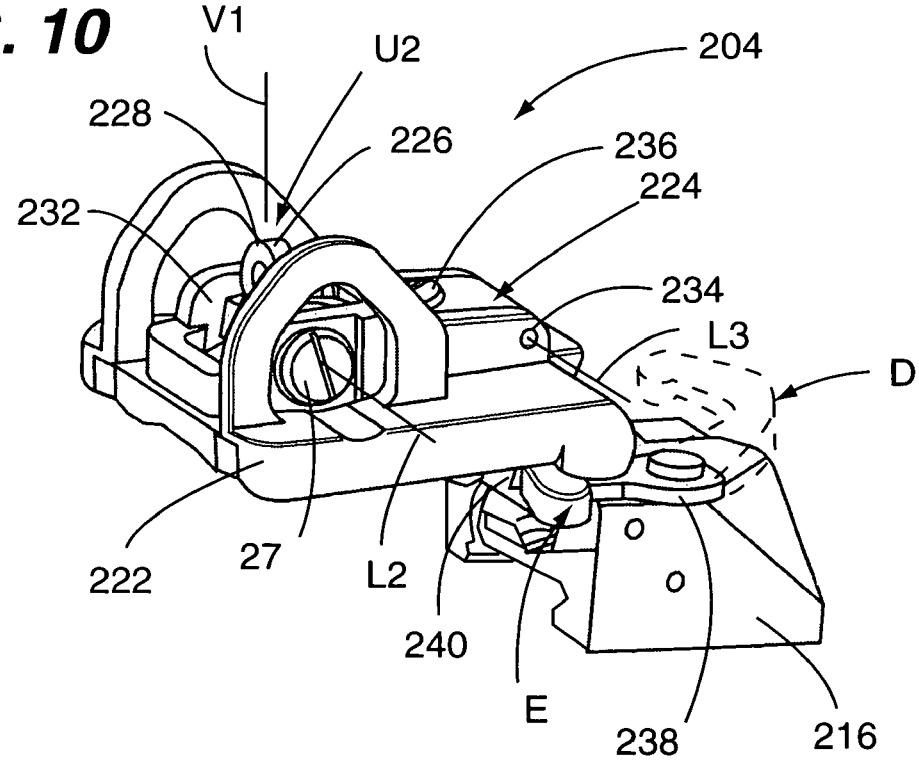
FIG. 10 is a perspective view of the single-mirror target viewing apparatus of FIG. 1 showing a locking member thereof in an engaged position for securing the single utilized mirror in the mirror use position.

Referring now, to FIGS. 8-10, the single-mirror target viewing apparatus 204 includes a sighting device 224 attached to a rear surface of the mirror casing 222. The single utilized mirror 218 is attached to a front surface of the mirror casing 222, which is opposite the rear surface. The sighting device 224 includes an alignment member 226 having two sighting structures. The alignment member 226 is pivotably mounted on a windage adjustment screw 227. A first sighting structure 228 is angularly offset from a second sighting structure 230 with respect to longitudinal axis L3 of the pivot member the windage adjustment screw 227 whereby pivoting of the alignment member about the longitudinal axis L2 of the windage adjustment screw 227 allows each one of the sighting structures (228, 230) to be moved to a sighting structure use position U2. A positive positioning structure is provided between the alignment member 226 and the mirror casing 222 for enabling each one of the sighting structures (228, 230) to be selectively and positively positioned in the sighting structure use position U2.

The first sighting structure 228 includes a first aperture 229 (i.e., a first sighting feature) having a first diametrical size. The second sighting structure 230 includes a second aperture 231 (i.e., a second sighting feature) having a second diametrical size different than the first diametrical size. The depicted apertures (229, 231) are examples of two different sighting features. In addition to the sighting features in accordance with the present invention being different size, it is disclosed herein that such sighting features can be shapes, relative positioning with respect to the longitudinal axis L2 of the windage adjustment screw 227, etc.

When the single-mirror target viewing apparatus 204 is properly attached to a gun and when a sighting feature of the alignment member 226 is in the sighting structure use position U2, that sighting feature is alignable with a mating alignment member of a companion sighting device (e.g., a front sight of the gun) when the single utilized mirror is in the sighting device used position U2. Accordingly, a person of ordinary skill will understand that examples of the mating alignment member of the companion sighting device include well-known mating alignment members such as a bead, an upstanding post, an upstanding bridge or the like. In general terms, such well-known mating alignment members can include mechanical structure that are positioned at a distance from another alignment member and that are configured for being aligned therewith. Such alignment provides for precision aiming of the gun through combined use of the sighting device 224 and the companion sighting device.

The alignment member 226 is mounted in a manner enabling independent adjustment for windage and for elevation. Adjustment for windage refers to lateral adjustment of the alignment member 226 along to the longitudinal axis 2 of the windage adjustment screw 227. Adjustment for elevation refers to vertical adjustment of the alignment member 226 along a vertical reference axis V1 extending through the longitudinal axis L2 of the windage adjustment screw 227.

For enabling windage adjustment, the windage adjustment screw 227 is mounted on a support member 232 whereby rotation of the windage adjustment screw 227 causes lateral translation of the windage adjustment screw 227 (i.e., along the longitudinal axis L2). The alignment member 226 is mounted on the windage adjustment screw 227 in a manner that enables pivoting of the alignment member 226 relative to the windage adjustment screw 227 and that substantially precludes lateral movement of the alignment member 226 with respect to the windage adjustment screw 227. Thus, lateral translation of the windage adjustment screw 227 results in a corresponding lateral translation of the alignment member 226.

For enabling elevation adjustment, the support member 232 is mounted on the mirror casing 222 in a manner enabling the support member 232 to be pivoted about a longitudinal axis L3 of a pivot member 234. The longitudinal axis L3 of the pivot member 234 extends parallel to the longitudinal axis L2 of the windage adjustment screw 227. An elevation adjustment screw 236 is engaged between the support member 232 and the mirror casing 222. Rotation of the elevation adjustment screw 236 causes the support member 232 to pivot correspondingly about the longitudinal axis L3 of the pivot member 234, thereby resulting in vertical movement of the alignment member 226 along a vertical reference axis V1.

Referring to FIG. 10, accuracy of aiming with the sighting device 224 requires repeatable and precise repositioning of the single utilized mirror 218 in the sighting device use position U2. Once the alignment member 226 is adjusted for windage and elevation with respect to companion sighing device, the degree of precision to which the single utilized mirror 218 can be repositioned in the sighting device use position U2 largely impacts accuracy in aiming. To thus end, a locking structure is provided between the mounting base 216 and the mirror assembly 214 for enabling the mirror assembly 214 to be fixedly retained in the sighting device use position U2 (i.e., a non-use position relative to a position in which the mirror assembly 214 is used). The locking structure includes a locking member 238 movably attached to the mounting base 216 and a slot 240 in the mirror casing 222 (i.e., a mating engagement feature fixedly attached to the mirror assembly 214). The locking member 238 is selectively movable between an engaged position E (i.e., within the slot 240) and a disengaged position D (i.e., removed from the slot 240). The locking member 238 is captured within the slot 240 (i.e., engages the mating engagement feature) when moved to the engaged position E while the mirror assembly 214 is in the sighting device use position U2, thereby jointly constrains movement of the single utilized mirror 218 with respect to the base attachment portion 220 and the mounting base 216. Additionally, the locking member 238 and the slot 240 are jointly configured (e.g., size, shape material, etc) whereby engagement of the locking member 238 within the slot 240 provides for precision repositioning (i.e., also referred to as zeroing) of the mirror assembly 214 in the sighting device use position U2.

Referring to FIGS. 5, 6, 11 and 12, the mirror shrouding apparatus 208 includes a mirror shrouding body 242 having an attachment region 244 engagable with the mounting rail 202 for enabling the mirror shrouding body 242 to be attached to a mating structure of a gun (e.g., an receiver, a barrel cover, integral mounting rail, etc) or an accessory item (e.g., a single-mirror target viewing apparatus 204 in accordance with the present invention). It is disclosed herein that the attachment region 244 may alternatively be configured for being engaged with the mating structure of a gun or the accessory item. It is further disclosed herein that the attachment region 244 may include an integral retention device (e.g., set screw or clamp arrangement) that secures the mirror shrouding apparatus 208 in place on the mounting rail 202 or may include an interlock feature that engages a mating interlock feature of the single-mirror target viewing apparatus 204 such that securing the mirror shrouding apparatus 208 in place on the mounting rail 202 via the clamping structure 245 (FIG. 8) of the mounting base 216 correspondingly secures the mirror shrouding apparatus 208 in place on the mounting rail 202.

When the mirror assembly 214 is in the stowed position S (FIG. 5) or the sighting device use position U2 (FIG. 6), the position, size and/or shape of the mirror shrouding body 242 with respect to that of the mirror assembly 214 serves to preclude all beams of light reflected by the target imaging surface from being visible at any remote location relative to the single-mirror target viewing apparatus 204 with the single-mirror target viewing apparatus 204 in any orientation (i.e., with the single-mirror target viewing apparatus 204 staying in a fixed position with respect to the mirror shrouding apparatus 208). In effect, the mirror shrouding body blocks all reflected beams of light after the beams of light impinge upon the target imaging surface of the single utilized mirror 218. In providing such functionality, the mirror shrouding body 242 precludes beams of light from impinging upon the target imaging surface of the single utilized mirror 218 and/or blocks a reflected portion of the beams of light after the beams of light impinge upon the target imaging surface of the single utilized mirror 218.

Figure 11:
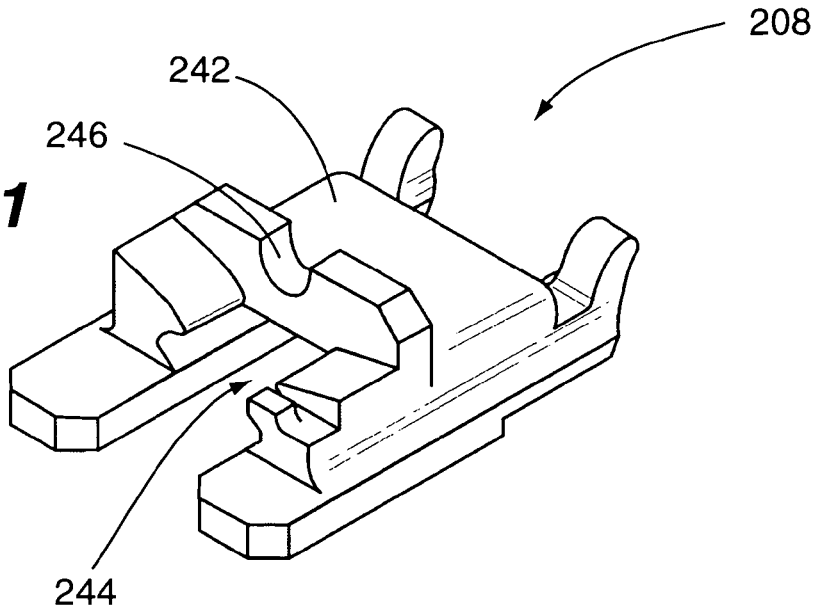
FIG. 11 is a perspective view showing an upper portion of an embodiment of a mirror shroud in accordance with the present invention.
Figure 12:
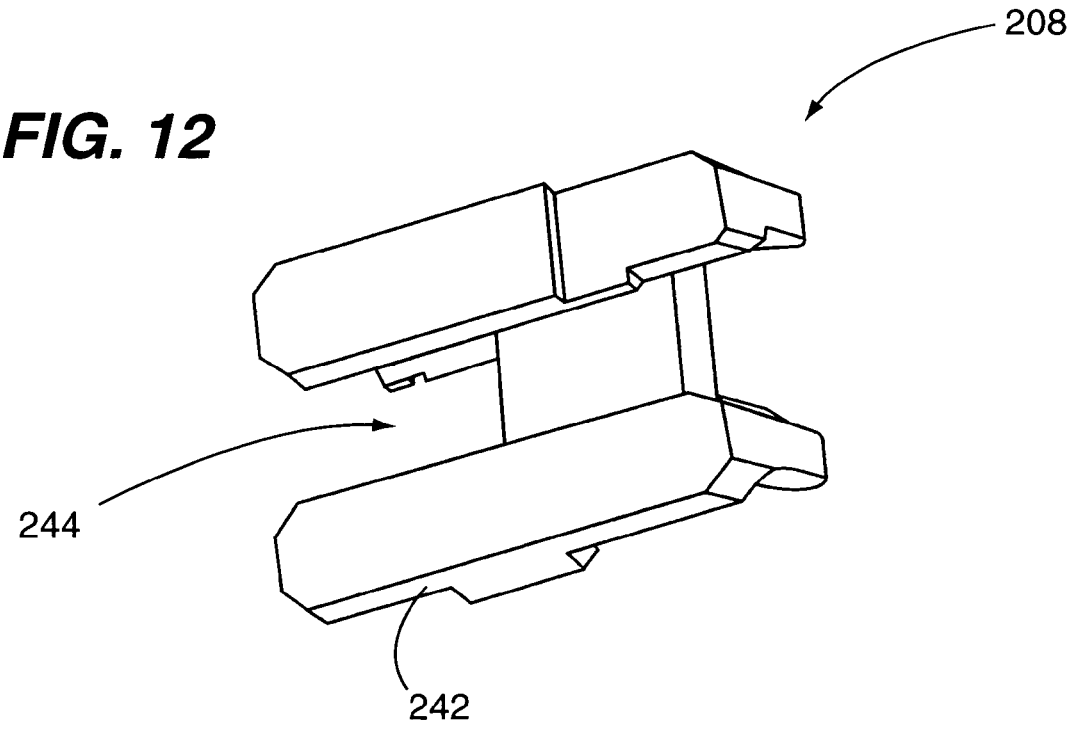
FIG. 12 is a perspective view of the mirror shroud of FIG. 11 showing a bottom portion of the mirror shroud.

The mirror shrouding body 242 includes a mirror casing receiving recess 246 (FIGS. 6 and 11). The mirror casing receiving recess 246 has disposed therein at least a portion of the mirror casing 222 of the single-mirror target viewing apparatus 204 when the single utilized mirror 218 is in the stowed position (i.e., a non-use position with respect to use of the single utilized mirror 218). The mirror casing receiving recess 246 advantageously permits spacing between the mirror shrouding body 242 and the single utilized mirror 218 to be maintained at a minimum distance when the single utilized mirror 218 is in the stowed position S and the sighting device use position U2.

Figure 13:
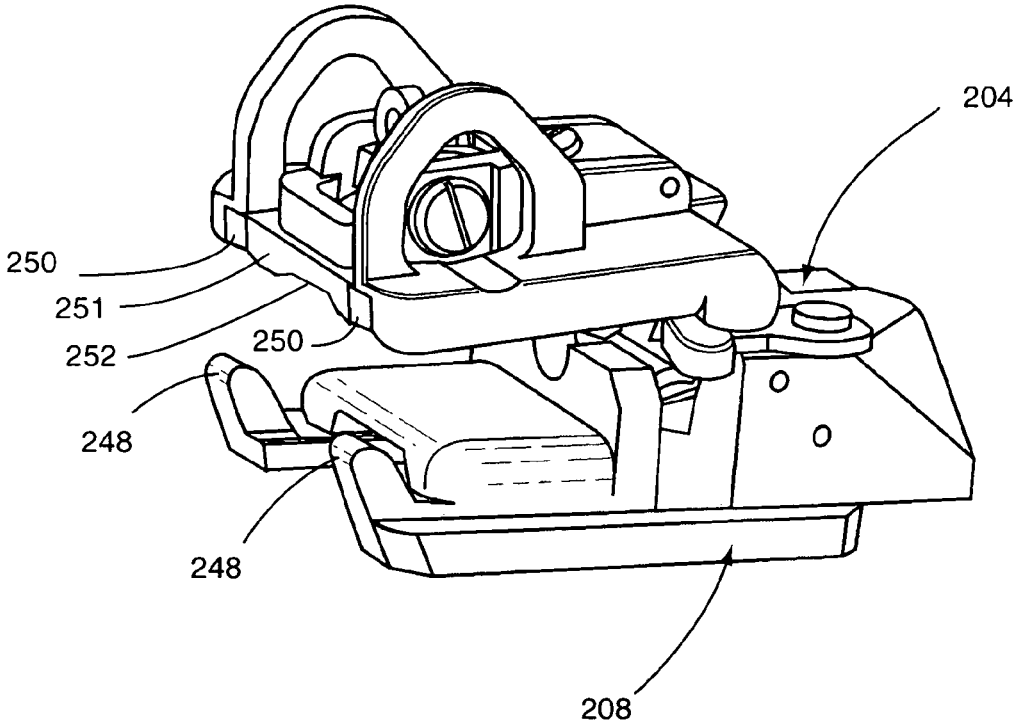
FIG. 13 is a perspective view showing the mirror shroud of FIGS. 11 and 12 engaged with the single-mirror target viewing apparatus of FIG. 1, wherein the single utilized mirror is in the sighting device use position.
Figure 14:
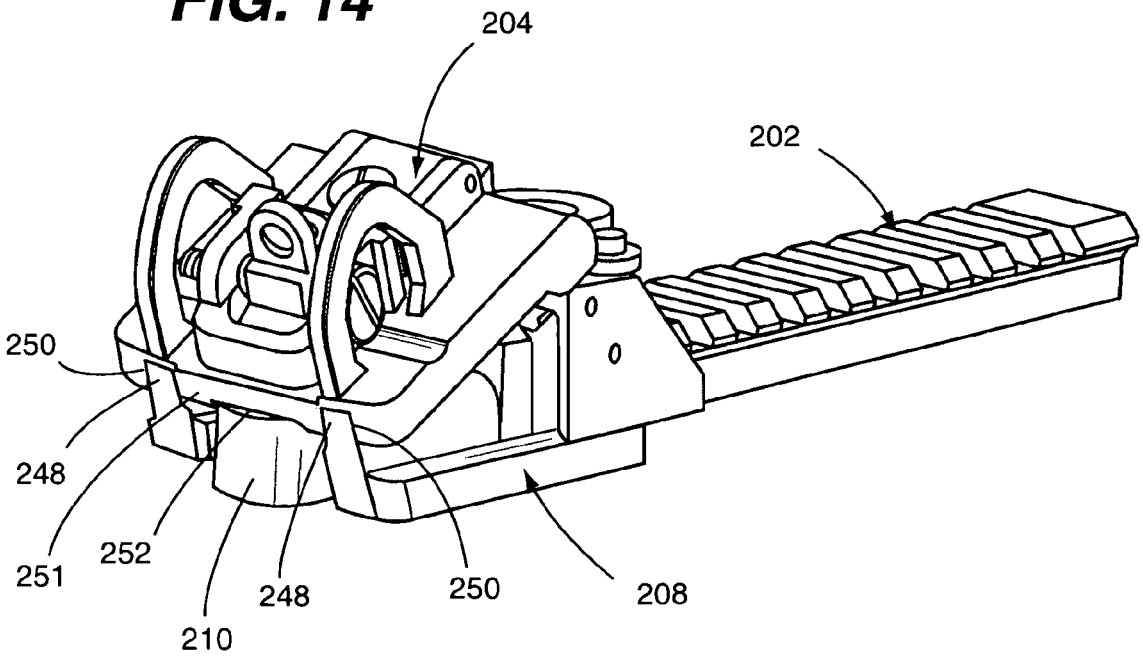
FIG. 14 is a perspective view showing the mirror shroud of FIGS. 11 and 12 engaged with the single-mirror target viewing apparatus of FIG. 1, wherein the single utilized mirror is in the stowed position.

Referring now to FIGS. 13 and 14, the mirror shrouding body 242 includes upstanding members 248 and an upper edge portion 251 of the mirror casing 222 includes upstanding member receiving recesses 250 therein. The upstanding members 248 engage the upstanding member receiving recesses 250 when the single utilized mirror 218 is in the stowed position S. When engaged, the upstanding members 248 and the upstanding member receiving recesses 250 jointly carry a load resulting from an externally applied force exerted on the mirror casing 222 thereby limiting deflection of the mirror casing in the downward and/or lateral directions. In doing so, the upstanding members 248 and the upstanding member receiving recesses 250 jointly reduce the potential for the externally applied force resulting in damage to the mirror assembly 214. It is disclosed herein that the upstanding member receiving recesses 250 may be provided in another region of the mirror casing 222 as opposed to the upper edge portion 251 of the mirror casing 222 (e.g., side edge portions).

Still referring to FIGS. 13 and 14, the mirror casing 222 includes a mounting rail receiving recess 252 in the upper edge portion edge 251. The mounting rail receiving recess 252 engages the top face of the mounting rail 204 when the single utilized mirror 218 is in the stowed position S. When engaged, the mounting rail receiving recess 252 and the mounting rail jointly carry a load resulting from an externally applied force exerted on the mirror casing 222 thereby limiting deflection of the mirror casing in the downward and lateral directions. In doing so, mounting rail receiving recess 252 and the mounting rail jointly reduce the potential for the externally applied force resulting in damage to the mirror assembly 214.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice embodiments of the inventive disclosures made herein. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A targeting apparatus for a gun, comprising:

a mirror assembly including a single utilized mirror having a target imaging surface, wherein the single utilized mirror is the only mirror of the mirror assembly utilized for targeting an object;

a mounting base having the mirror assembly moveably attached thereto, wherein the mirror assembly is movable between a sighting device use position thereof with respect to the mounting base and a mirror use position thereof with respect to the mounting base; and a sighting device attached to the mirror assembly in a manner whereby the mirror assembly and the sighting device move in unison when the mirror assembly is moved with respect to the mounting base, wherein the sighting device includes an alignment member configured for being aligned with a mating alignment member of a companion sighting device when the single utilized mirror is in the sighting device used position thereby enabling precision aiming through combined use of said sighting devices and wherein the alignment member is independently adjustable for windage and for elevation.

2. The targeting apparatus of claim 1, further comprising:

a first positive positioning structure provided between the mirror assembly and the mounting base; and a second positive positioning structure provided between the single utilized mirror and a base attachment portion of the mirror assembly;

wherein said positive position structures jointly enable the single utilized mirror to be positively positioned in a plurality of predefined positions; and wherein the sighting device use position is a first one of said predefined positions and the use position of the single utilized mirror is a second one of said predefined positions.

3. The targeting apparatus of claim 2 wherein:

the single utilized mirror is movable to a stowed position with respect to the mounting base; and the stowed position is a third one of said predefined positions.

4. The targeting apparatus of claim 3 wherein:

the mirror assembly is pivotably attached to the mounting base thereby enabling the mirror assembly to be pivoted between a plurality of positions thereof with respect to the mounting base; and the single utilized mirror is rotationally attached to the base attachment portion of the mirror assembly thereby enabling the single utilized mirror to be pivoted between a plurality of positions thereof with respect to the base attachment portion.

5. The targeting apparatus of claim 2, further comprising:

a locking structure provided between the mounting base and the mirror assembly for enabling the single utilized mirror to be fixedly retained in the sighting device use position.

6. The targeting apparatus of claim 5 wherein:

the locking structure includes a locking member movably attached to the mounting base and a mating engagement feature fixedly attached to the mirror assembly;

the locking member is movable between an engaged position and a disengaged position; and the locking member engages the mating engagement feature when moved to the engaged position while the single utilized mirror is in the sighting device use position.

7. The targeting apparatus of claim 1, further comprising:

a locking structure provided between the mounting base and the mirror assembly for enabling the single utilized mirror to be fixedly retained in the sighting device use position.

8. The targeting apparatus of claim 7 wherein:

the locking structure includes a locking member movably attached to the mounting base and a mating engagement feature fixedly attached to the mirror assembly;

the locking member is movable between an engaged position and a disengaged position; and the locking member engages the mating engagement feature when moved to the engaged position while the single utilized mirror is in the sighting device use position.

9. The targeting apparatus of claim 1 wherein:

the mirror assembly includes a mirror casing having a first surface and a second surface spaced apart from the first surface;

the single utilized mirror is attached to the first surface of the mirror casing; and the sighting device is attached to the second surface of the mirror casing.

10. A targeting system for a gun, comprising:

a target acquisition apparatus including a mounting structure interlockedly engagable with a mating engagement portion of a mounting rail of a gun for enabling the target acquisition apparatus to be secured to the mounting rail and including a means for visually indicating when the gun is aimed at a desired target;

a single-mirror target viewing apparatus including a mounting base and a mirror assembly movably attached to the mounting base, wherein the mounting base includes a mounting structure interlockedly engagable with the mating engagement portion of the mounting rail for enabling the single-mirror target viewing target apparatus to be secured to the mounting rail, wherein the mirror assembly includes a single utilized mirror providing a target imaging surface, wherein the single-mirror target viewing apparatus enables a shooter to view on the target imaging surface both the desired target and the means for visually indicating when the gun is aimed at a desired target while the target acquisition apparatus and the single-mirror target viewing apparatus are both secured to the mounting rail with the single utilized mirror in the mirror use position and wherein the single utilized mirror is the only mirror of the mirror assembly utilized for targeting an object; and a sighting device attached to the mirror assembly of the single-mirror target viewing apparatus in a manner whereby the mirror assembly and the sighting device move in unison when the mirror assembly is moved with respect to the mounting base, wherein an alignment member of the sighting device is alignable with a mating alignment member of a companion sighting device when the single utilized mirror is in the sighting device use position thereby enabling precision aiming through combined use of said sighting devices, wherein the sighting device is separate from and spaced apart from the companion sighting device, and wherein the alignment member is independently adjustable for windage and for elevation.

11. The targeting system of claim 10 wherein:

the single utilized mirror is movably attached to the mounting base;

the single utilized mirror is movable between a non-use position thereof with respect to the mounting base and a use position thereof with respect to the mounting base; and the single utilized mirror is in the non-use position thereof when the sighting device is in the use position thereof.

12. The targeting system of claim 11, further comprising:

a first positive positioning structure provided between the mirror assembly and the mounting base; and a second positive positioning structure provided between the single utilized mirror and a base attachment portion of the mirror assembly;

wherein said positive position structures jointly enable the single utilized mirror to be positively positioned in a plurality of predefined positions; and wherein the sighting device use position is a first one of said predefined positions and the use position of the single utilized mirror is a second one of said predefined positions.

13. The targeting system of claim 12 wherein:

the single utilized mirror is movable to a stowed position thereof with respect to the mounting base; and the stowed position is a third one of said predefined positions.

14. The targeting system of claim 13 wherein:

the mirror assembly is pivotably attached to the mounting base thereby enabling the single utilized mirror to be pivoted between a plurality of positions thereof with respect to the mounting base; and the single utilized mirror is rotationally attached to the base attachment portion of the mirror assembly thereby enabling the single utilized mirror to be pivoted between a plurality of positions thereof with respect to the base attachment portion.

15. The targeting system of claim 14, further comprising:

a locking structure provided between the mounting base and the mirror assembly for enabling the single utilized mirror to be fixedly retained in the sighting device use position.

16. The targeting system of claim 15 wherein:

the locking structure includes a locking member movably attached to the mounting base and a mating engagement feature fixedly attached to the mirror assembly;

the locking member is movable between an engaged position and a disengaged position; and the locking member engages the mating engagement feature when moved to the engaged position while the single utilized mirror is in the sighting device use position.

17. The targeting system of claim 10, further comprising:

a locking structure provided between the mounting base and the mirror assembly for enabling the single utilized mirror to be fixedly retained in the sighting device use position.

18. The targeting system of claim 17 wherein:

the locking structure includes a locking member movably attached to the mounting base and a mating engagement feature fixedly attached to the mirror assembly;

the locking member is movable between an engaged position and a disengaged position; and the locking member engages the mating engagement feature when moved to the engaged position while the single utilized mirror is in the sighting device use position.

19. The targeting system of claim 10 wherein:

the mirror assembly includes a mirror casing having a first surface and a second surface spaced apart from the first surface;

the single utilized mirror is attached to the first surface of the mirror casing; and the sighting device is attached to the second surface of the mirror casing.

20. A targeting apparatus for a gun, comprising:

a mounting rail;

a single-mirror target viewing apparatus including a mounting base and a mirror assembly movably attached to the mounting base, wherein the mounting base is attached to the mounting rail, wherein the mirror assembly includes a single utilized mirror providing a target imaging surface, wherein the single-mirror target viewing apparatus enables a shooter to view on the target imaging surface both the desired target and means for visually indicating when the gun is aimed at a desired target while the target acquisition apparatus and the single-mirror target viewing apparatus are both secured to the mounting rail with the single utilized mirror in the mirror use position and wherein the single utilized mirror is the only mirror of the mirror assembly utilized for targeting an object;

a sighting device attached to the mirror assembly in a manner whereby the mirror assembly and the sighting device move in unison when the mirror assembly is moved with respect to the mounting base, wherein the sighting device includes an alignment member configured for being aligned with a mating alignment member of a companion sighting device when the single utilized mirror is in the sighting device used position thereby enabling precision aiming through combined use of said sighting devices, wherein the sighting device is separate from and spaced apart from the companion sighting device, and wherein the alignment member is independently adjustable for windage and for elevation;

a plurality of positive positioning structures, wherein a first positive positioning structure provided between the mirror assembly and the mounting base, wherein a second positive positioning structure provided between the single utilized mirror and a base attachment portion of the mirror assembly, wherein said positive position structures jointly enable the single utilized mirror to be positively positioned in a plurality of predefined positions and wherein the sighting device use position is a first one of said predefined positions and the use position of the single utilized mirror is a second one of said predefined positions; and a locking structure provided between the mounting base and the mirror assembly for enabling the single utilized mirror to be fixedly retained in the sighting device use position.

* * * * *